US008986017B2

(12) United States Patent
Borg

(10) Patent No.: US 8,986,017 B2
(45) Date of Patent: Mar. 24, 2015

(54) ROTATABLE ELECTRIC COUPLING APPARATUS AND METHOD

(71) Applicant: OASYS Healthcare Corporation, Uxbridge (CA)

(72) Inventor: Vincent A. Borg, Uxbridge (CA)

(73) Assignee: OASYS Healthcare Corporation, Uxbridge (CA)

( * ) Notice: Subject to any disclaimer, the term of this patent is extended or adjusted under 35 U.S.C. 154(b) by 0 days.

(21) Appl. No.: 14/064,614

(22) Filed: Oct. 28, 2013

(65) Prior Publication Data

US 2014/0120741 A1 May 1, 2014

Related U.S. Application Data

(60) Provisional application No. 61/718,755, filed on Oct. 26, 2012.

(51) Int. Cl.

| | |
|---|---|
| ***H01R 39/00*** | (2006.01) |
| ***H01R 39/64*** | (2006.01) |
| ***H01R 43/14*** | (2006.01) |
| *H01R 24/38* | (2011.01) |
| *H01R 24/58* | (2011.01) |

(52) U.S. Cl.

CPC ..... *H01R 39/64* (2013.01); *H01R 43/14* (2013.01); *H01R 24/38* (2013.01); *H01R 24/58* (2013.01)

USPC ..... 439/13; 310/232

(58) Field of Classification Search

CPC ..... H01R 24/58; H01R 35/04; H01R 39/00; H01R 39/64; H01R 39/04; H01R 39/08

USPC ..... 439/11, 13, 18, 22–28, 668, 669; 310/232, 233

See application file for complete search history.

(56) References Cited

U.S. PATENT DOCUMENTS

| | | | | |
|---|---|---|---|---|
| 3,860,312 | A | 1/1975 | Gordon, Jr. | |
| 6,561,813 | B2 * | 5/2003 | Rutten et al. | 439/26 |
| 7,074,044 | B2 | 7/2006 | Billing et al. | |
| 7,307,367 | B2 | 12/2007 | Angerpointner et al. | |
| 7,322,858 | B1 * | 1/2008 | Rogers et al. | 439/669 |
| 7,481,655 | B2 * | 1/2009 | Horst et al. | 439/24 |
| 7,701,108 | B2 * | 4/2010 | Yu et al. | 310/232 |

(Continued)

FOREIGN PATENT DOCUMENTS

| | | | |
|---|---|---|---|
| DE | 8802467 | U1 | 4/1988 |
| WO | 03092127 | A1 | 11/2003 |

(Continued)

*Primary Examiner* — Thanh Tam Le

(74) *Attorney, Agent, or Firm* — Jonathan M. D'Silva; MacDonald, Illig, Jones & Britton LLP

(57) ABSTRACT

What is presented is a method of manufacturing a rotatable electric coupling. The rotatable electric coupling comprises a male connector half and a female connector half. The male connector half comprises one or more male coupling parts, one or more male insulator elements, and a male connector core that has a central burrow. The female connector half comprises a female core base having a channel, one or more female coupling parts that have a channel extender, one or more female core spacers that also have a channel extender, and a female end cap. The method comprises assembling the male connector half, assembling the female connector half, and inserting the male connector half into the female connector half.

35 Claims, 10 Drawing Sheets

(56) References Cited

U.S. PATENT DOCUMENTS

| | | | | |
|---|---|---|---|---|
| 7,896,708 | B2 * | 3/2011 | Agevik | 439/669 |
| 8,025,506 | B2 * | 9/2011 | Cairns | 439/24 |
| 8,348,677 | B2 | 1/2013 | Angerpointner et al. | |
| 8,651,750 | B2 * | 2/2014 | Terlizzi et al. | 385/75 |
| 8,899,991 | B2 * | 12/2014 | Ickler | 439/11 |
| 2009/0286427 | A1 | 11/2009 | Bolin et al. | |
| 2011/0042133 | A1 | 2/2011 | Lythcott | |
| 2012/0220141 | A1 | 8/2012 | Ickler | |
| 2012/0228454 | A1 | 9/2012 | Kroenung | |

FOREIGN PATENT DOCUMENTS

| | | | |
|---|---|---|---|
| WO | 2011042133 | A1 | 4/2011 |
| WO | 2012095323 | A1 | 7/2012 |

* cited by examiner

ROTATABLE ELECTRIC COUPLING APPARATUS AND METHOD

This application takes priority from U.S. provisional application No. 61/718,755 filed Oct. 26, 2012, which is incorporated herein by reference.

BACKGROUND

Pendant arm systems used in medical, commercial, and industrial environments typically support or suspend technical equipment needing electric transmissions for their operation. These electrical transmissions may be power or communications. The pendant arm systems allow users to position such technical equipment (including surgical lights, cameras, monitors/displays, yolks, and other devices) using rotational pivot joints. These rotational pivot joints need a reliable rotational electrical connection to provide the technical equipment uninterrupted electrical transmissions. The sizing limitations of the pivot joints require any internal elements to be miniature, while still being able to properly provide reliable electric transmissions. What is presented is a rotatable electric coupling apparatus small enough to secure into the pivot joint of a pendant arm system, or another similar type of apparatus, that provides and maintains a reliable and limitless rotatable electric connection. What is also presented is the method of manufacturing this rotatable electric coupling.

SUMMARY

What is presented is a rotatable electric coupling for maintaining a continuous electric connection through the pivot joint of a pendant arm system, or another similar apparatus that comprises a pivot joint. The rotatable electric coupling comprises a female connector half, a male connector half, and the female connector half corresponds with the male connector half in a way that maintains a continuous electric connection.

The female connector half comprises both a female connector core and a female connector housing. The female connector core comprises a female coupling part, a female core spacer, and a female core base. The female coupling part operatively contacts a corresponding male coupling part, in the male connector half, in such a way that they work in conjunction to maintain a rotational connection. The female core spacer is fastened to the female coupling part and is used to insulate the female coupling part. Both the female core spacer and said female coupling part are mounted to the female core base, which stabilizes the entire female connector core when the female connector core is inserted in the female connector half. The female core base also comprises a channel that is extended when either or both the female core spacer and female coupling part are mounted on the female core base. When the female connector core is complete, the channel laterally extends along the entire length of the female connector core.

The male connector half comprises the male coupling part, a male insulator element, and a male connector core. As mentioned above, the male coupling part operatively contacts the corresponding female coupling part, in such a way that they work in conjunction to maintain a rotational connection. The male insulator element is fastened to the male coupling part and insulates the male coupling part. Both the male coupling part and male insulator element are mounded on the male connector core, which has a central burrow. The male connector core stabilizes both the male coupling part and the male insulator element, when the male connector half is operatively inserted into the female connector half.

In certain instances, an electrical conduit can be joined to the female coupling part and the electrical conduit could also be secured within the channel using dielectric adhesive. A female end cap could also be fastened to the female connector core. The female core spacer could comprise a plurality of radial sections for fastening to the female coupling part and the female coupling part could also comprise a plurality of outward radial tabs with at least one of those outward radial tabs used for fastening to the radial section of the female core spacer. The female core base could also comprise a plurality of radial segments that are used for fastening to the female core spacer. The female coupling part could also comprise a plurality of inward radial tabs bent peripherally for operatively contacting the corresponding said male coupling part.

The female connector half may comprise a plurality of female coupling parts, with at least one of said female coupling parts being made from nonconductive material. The female core base could also have a plurality of channels, with each channel being extended when the female core spacer and female coupling part are mounted on the female core base.

In other instances, an electrical conduit could be joined to the male coupling part, a coaxial cable for transmitting an electric control signal could be inserted into the central burrow, and/or the central burrow of the male connector core could be filled with dielectric adhesive. The male coupling part could comprise an elongated divot and the male insulator element could comprise a peg, the peg is able to be interlocked with the elongated divot. The male connector core could comprise a lateral flange for securing the rotatable electric coupling to the pivot joint of a medical spring arm. The male connector half could comprise a plurality of male coupling parts with at least one of those male coupling parts made from nonconductive material. Finally, a limitless rotational connection between both the male coupling part and female coupling part could be created when the female coupling part operatively contacts the corresponding male coupling part.

What is also presented is a method of manufacturing the rotatable electric coupling. The method comprises assembling the male connector half, assembling the female connector half, and inserting the male connector half into the female connector half. Assembling the male connector half comprises the steps of—(1) mounting one male coupling part on the male connector core, (2) mounting one male insulator element on the male connector core, repeating steps (1) or (2) or both (1) and (2) until all male coupling parts and all male insulator elements are mounted on the male connector core. Assembling the male connector half also comprises filling the central burrow in the male connector core with dielectric adhesive. Assembling the female connector half comprises the steps of—(1) fastening one female coupling part to one female core spacer in such a way that the channel extenders are aligned, (2) stacking the fastened female coupling part and female core spacer on the female core base or stacking them on an already stacked female coupling part and female core spacer. This stacking should be done in a way that the channel of the female core base is extended by the channel extenders of the fastened female coupling parts and female core spacers. Repeating steps (1) or (2) or both (1) and (2) until all fastened female coupling parts and female core spacers are stacked on the female core base or stacked on an already stacked female coupling part and female core spacer, which, when these steps are complete, creates a female connector core. Assembling the female connector half also comprises—fastening the female end cap to the female connector core, applying dielectric adhesive throughout the channel of the female connector core, and inserting the female connector core and female end cap into a female connector housing.

Assembling the male connector half could also comprise—joining each male coupling part to an electrical conduit, interlocking the peg of the male insulator element with the elongated divot of the male coupling part, and/or inserting a coaxial cable into the central burrow of the male connector core. Assembling the female connector half could also comprise—joining each female coupling part to an electrical conduit, and/or fixedly securing a coaxial contact member to the female end cap. In certain instances, the male connector is only able to mount at most nine male coupling parts. The number of female coupling parts used in the manufacture of the rotatable electric coupling could be equal to the number of male coupling parts, less than the number of male coupling parts, or more than the number of male coupling parts.

Those skilled in the art will realize that this invention is capable of embodiments that are different from those shown and that details of the devices and methods can be changed in various manners without departing from the scope of this invention. Accordingly, the drawings and descriptions are to be regarded as including such equivalent embodiments as do not depart from the spirit and scope of this invention.

BRIEF DESCRIPTION OF DRAWINGS

For a more complete understanding and appreciation of this invention, and its many advantages, reference will be made to the following detailed description taken in conjunction with the accompanying drawings.

DETAILED DESCRIPTION

Figure 1:
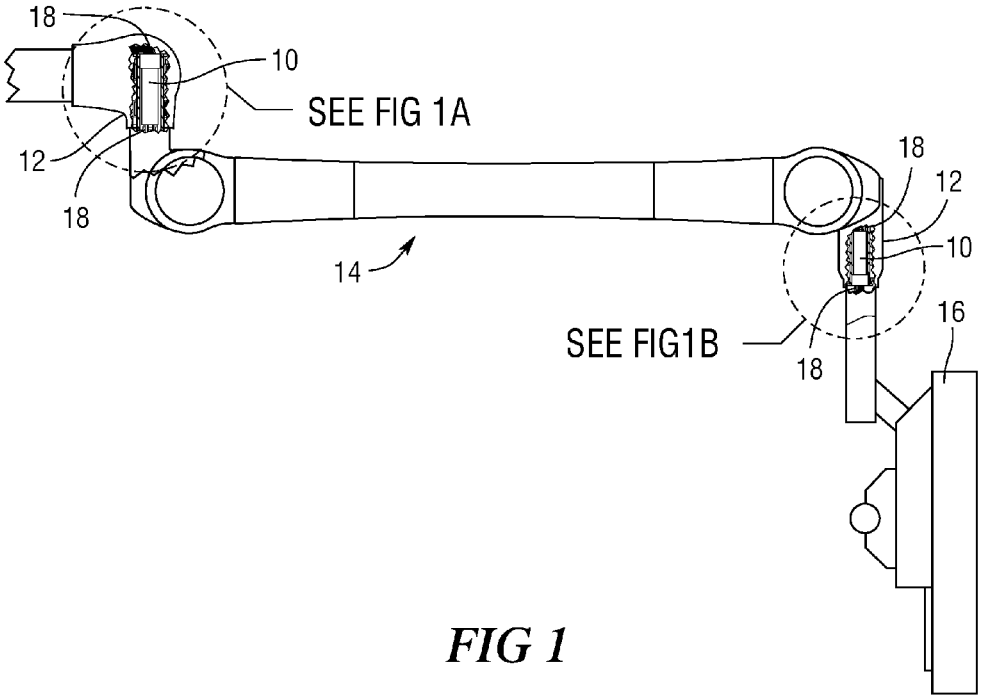
FIG. 1 is a side view of rotatable electric couplings installed in the pivot joints of a pendant arm system.
Figure 1A:
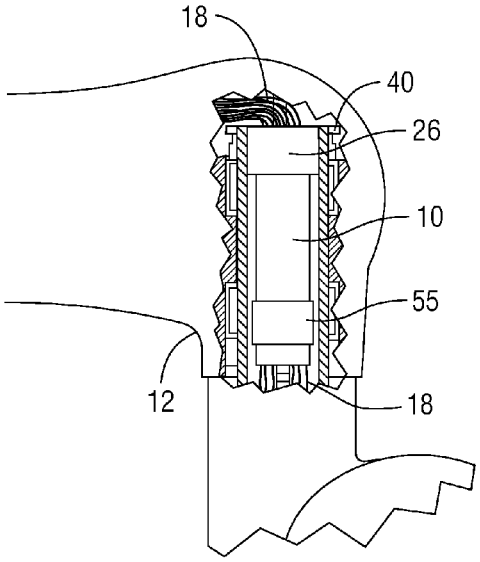
FIG. 1A is a close up view of one of the rotatable electric couplings of FIG. 1.

Referring to the drawings, some of the reference numerals are used to designate the same or corresponding parts through several of the embodiments and figures shown and described. Corresponding parts are denoted in different embodiments with the addition of lowercase letters. Variations of corresponding parts in form or function that are depicted in the figures are described. It will be understood that variations in the embodiments can generally be interchanged without deviating from the invention.

Figure 1B:
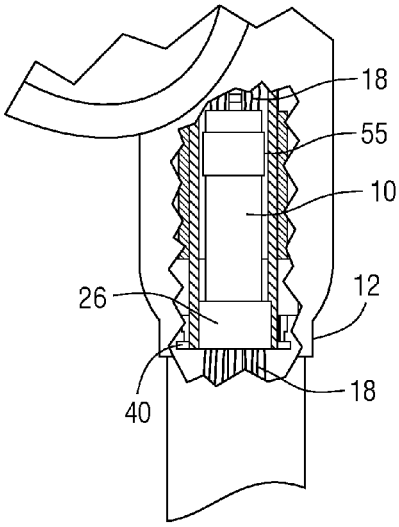
FIG. 1B is a close up view of another of the rotatable electric couplings of FIG. 1.

As shown in FIGS. 1 through 1B, a rotatable electric coupling 10 is positioned in each pivot joint 12 (also known as a swivel joint) of a pendant arm system 14 used to support technical equipment 16, such as the LCD monitor shown in FIG. 1. The rotatable electric coupling 10 connects electrical conduit 18 through the pendant arm system 14 to the supported attached technical equipment 16. This connection provides the technical equipment 16 mounted on the pendant arm system 14 with stable, continuous electrical transmissions (including, but not limited to, electric power and electric communication signals). The rotatable electric coupling 10 or the pivot joint 12 may also be provided with adjustable stops (not shown) to limit the rotational movement of the pendant arm system 14 beyond certain angles. While such stops may be necessary due to the structural limitations of the pendant arm system 14, the rotatable electric coupling 10 is designed to fully rotate 360 degrees without disrupting the continuous electric connection through the pivot joint 12. It should be understood that the rotatable electric coupling 10 could be installed in other apparatuses that require continuous electric connections through a rotational movement of a joint.

Figure 2:
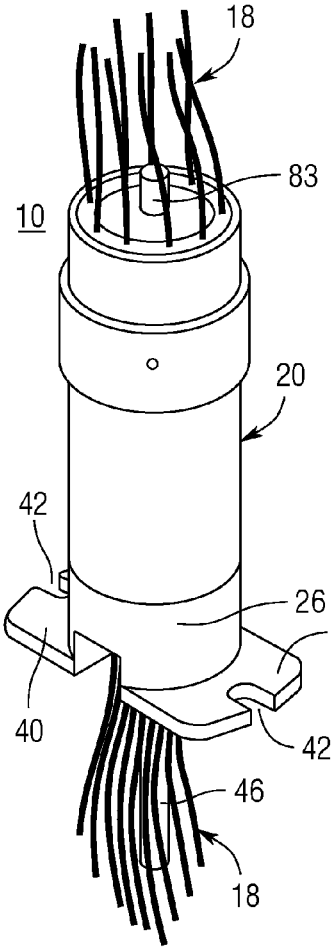
FIG. 2 is a perspective view of one of the rotatable electric couplings of FIG. 1.
Figure 3:
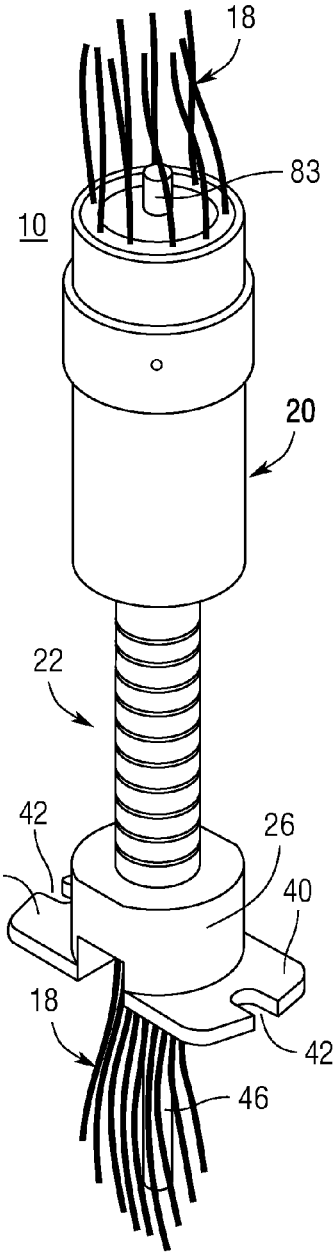
FIG. 3 is a perspective view of one of the rotatable electric couplings of FIG. 1, wherein the female connector half and the male connector half are partially disconnected.
Figure 4:
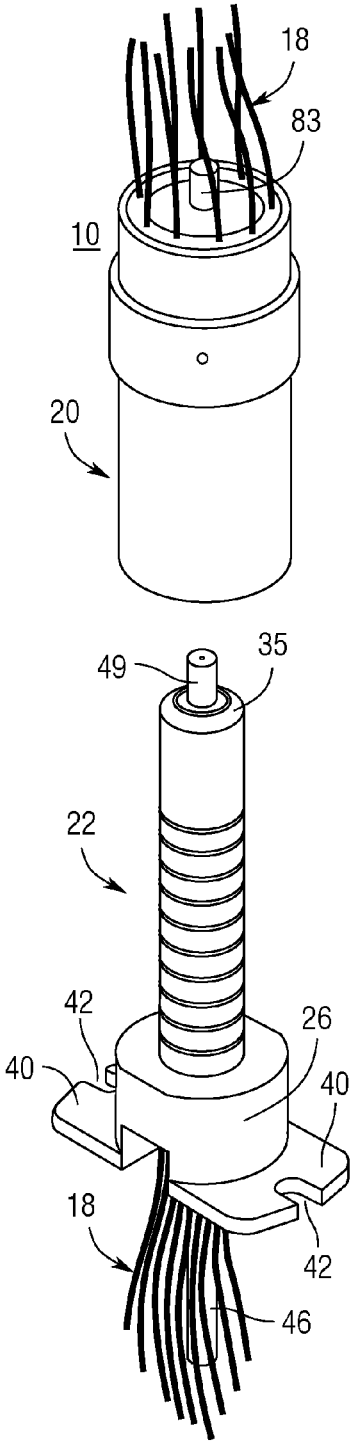
FIG. 4 is a perspective view of one of the rotatable electric couplings of FIG. 1, wherein the female connector half and the male connector half are fully disconnected.
Figure 5:
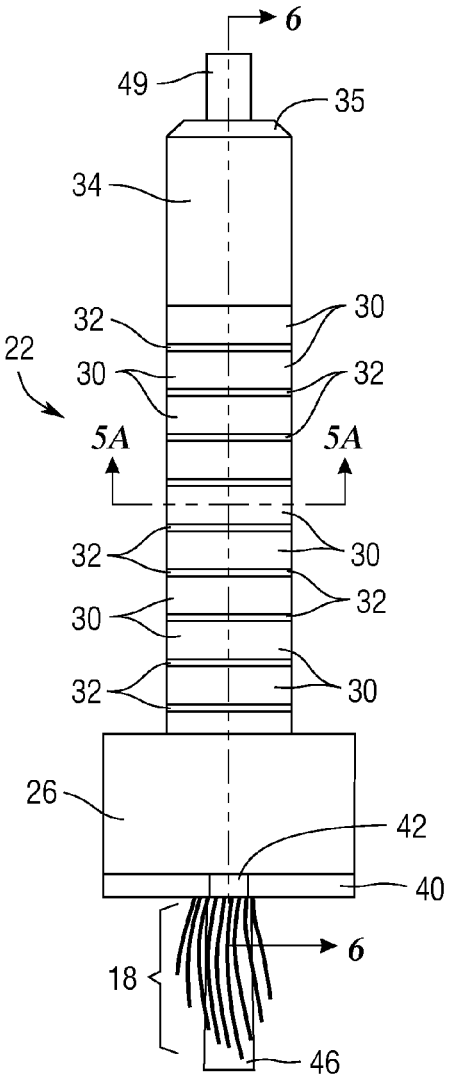
FIG. 5 is a side view of the male connector half of a rotatable electric coupling.
Figure 5A:
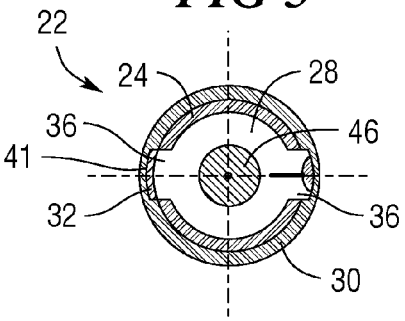
FIG. 5A is a cross-sectional top view of the male connector half of FIG. 5, as depicted by the figure line 5A-5A.
Figure 6:
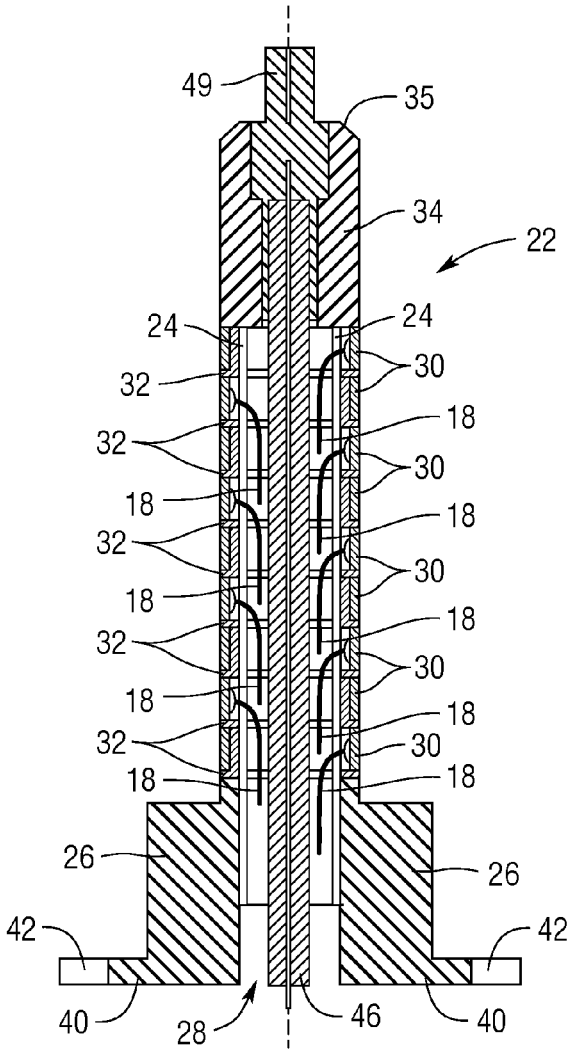
FIG. 6 is a cross-sectional side view of the male connector half of FIG. 5, as depicted by the figure line 6-6.
Figure 7:
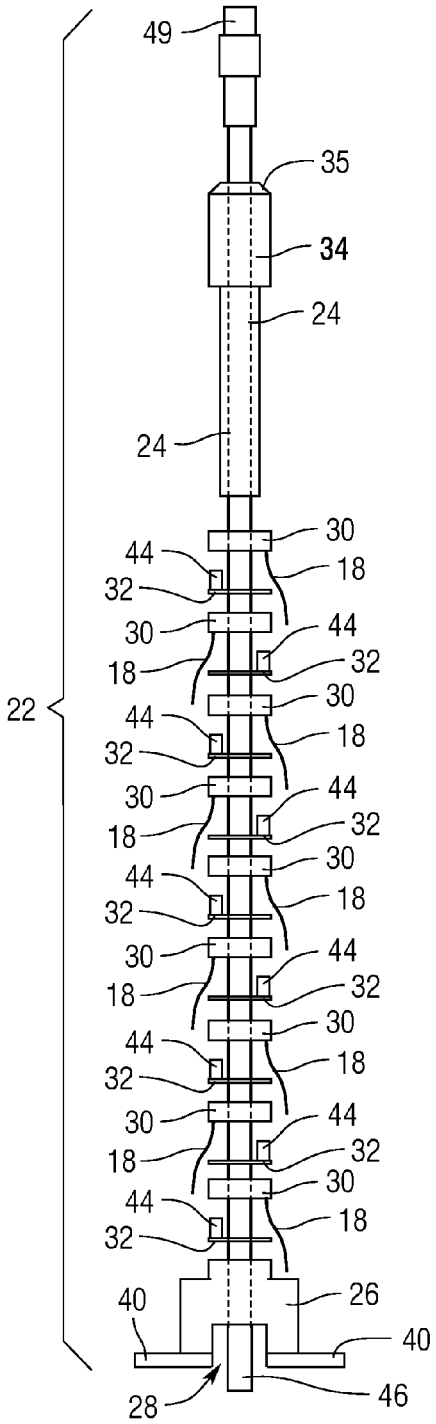
FIG. 7 is an exploded view of the male connector half of FIG. 5.
Figure 8:
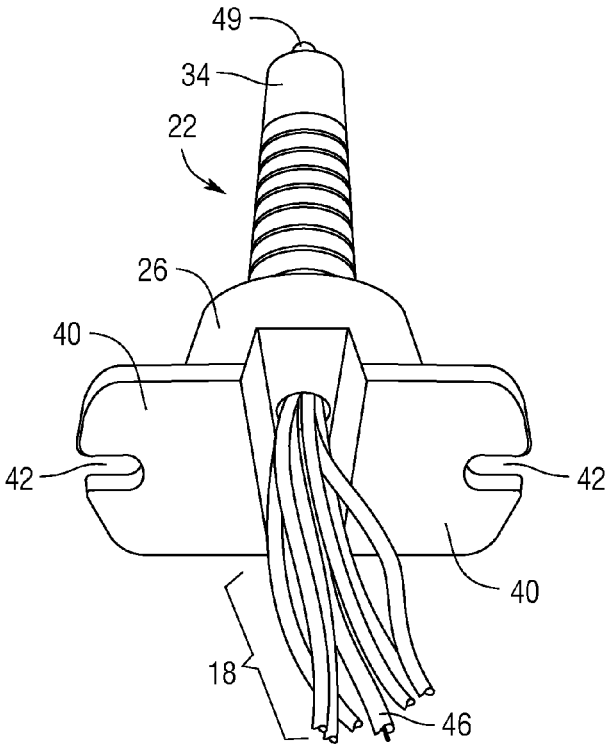
FIG. 8 is a rear perspective view of the male connector half of FIG. 5.
Figure 9:
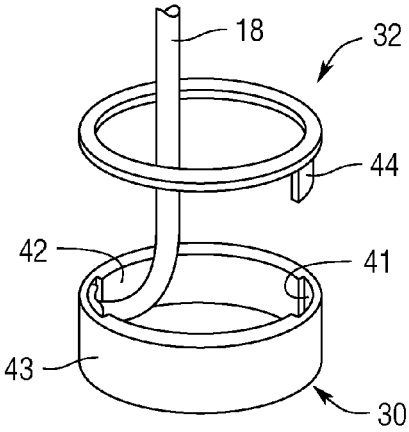
FIG. 9 is a perspective view of a male coupling part and a male insulator element separated from each other.

As shown in FIGS. 2 through 4, the rotatable electric coupling 10 comprises a female connector half 20 and a corresponding male connector half 22 to maintain a continuous electric connection through individual electrical conduits 18 connected to the female connector half 20 and the male connector half 22. The male connector half 22 is operatively inserted into an opening (discussed below) located at one end of the female connector half 20. Once operatively inserted, the male connector half 22 and female connector half 20 are rotatable relative to each other and the male connector half 22 can be easily detached and operatively reinserted back into the female connector half 20 when needed. When the rotatable electric coupling 10 is positioned in the pivot joint of a pendant arm system 14, the male connector half 22 remains stationary and acts as a stator element, whereas, the female connector half 20 rotates and acts as a rotor element. Properly inserting the male connector half 22 into the female connector half 20 also completes the electrical connection for each electrical conduit 18 through the entire rotatable electric coupling 10.

The male connector half 22 comprises two lateral flanges 40 each comprising a notch 42. Referring back to FIGS. 1 through 1B, it can be seen that the flanges 40 and notches 42 position and secure the rotatable electric coupling 10 into the pivot joint of the pendant arm system 14. Typically, the pendant arm system 14 or pivot joint 12 has some kind of corresponding extrusions (not shown) that interlock into each notch 42 to hold the rotatable electric coupling 10 in place. A joining mechanism (not shown) could also be inserted through each notch 36 and into the pendant arm system 14 to hold the rotatable electric coupling 10 in place.

As can be seen in FIGS. 1 through 1B, the rotatable electric coupling 10 functions in any orientation with the electric transmissions going first through either the male connector half 22 or the female connector half 20. In some embodiments of the rotatable electric coupling 10 (not shown), ball bearings could be used to assist the rotation of the rotatable electric coupling 10, but this is not required in the embodiments shown. When the pendant arm system 14 is manufactured, the male connector half 22 may be installed into one half of the pivot joint 12 and the female connector half 20 may be installed into the other half of the pivot joint 12. When two halves of the pivot joints 12 are assembled, the male connector part 22 should be simply inserted into the female connector half 20 to complete the pivot joint 12, as discussed above. So long as the proper connections with the electrical conduit 18 are established, no further electric connections need to be made within the pivot joint 12.

Referring to FIGS. 5 through 9, the male connector half 22 comprises a male connector core 24, a male support 26, a tip 34, and a central burrow 28 running centrally through the entire male connector core 24. The male connector half 22 also comprises a plurality of metallic electrically conductive male coupling parts 30 and nonconductive male insulator elements 32 laterally mounted along the outside of the male connector core 24 between the male support 26 and the tip 34. When operatively inserted into the female connector half (not shown), the male coupling parts 30 are correctly positioned to contact a metallic electrically conductive corresponding female coupling part (as discussed below) in a way that maintains a limitless rotational electrical connection. The limitless rotational electrical connection is one in which the male coupling parts 30 and female coupling parts are connected in such a way that each can rotate 360 degrees, or beyond, relative to each other without causing any disruption in their electrical connection.

The male connector core 24 stabilizes and correctly positions the male coupling parts 30 and male insulator elements 32, when the male connector half 22 is operatively inserted into the female connector half 20. The male connector core 24 is generally made from injection molded nonconductive polymer plastic material, but may be made from any nonconductive material able to stabilize both the male coupling parts 30 and male insulator elements 32 as well as be formed into a similar shape.

The male connector core 24 generally has a tubular shape with a circular cross-section (not shown). The cross-section of the tip 34 is wider in diameter than the cross-section of the male connector core 24. The mounted male coupling parts 30 and mounted male insulator elements 32 press against one side of the tip 34, helping to maintain their position on the male connector core 24. A tip chamfer 35 assists in guiding the male connector half 22 into the female connector half 20 (as shown in FIGS. 2-4). The male connector core 24 also has two elongated openings 36 oriented opposite each other that run laterally down the length of the male connector core 24. The elongated openings 36 allow for the electrical conduit 18 joined to each male coupling part 30 to go into the central burrow 28 of the male connector half 22. The male shaft support 26 provides a base for the male connector core 24.

Figure 10:
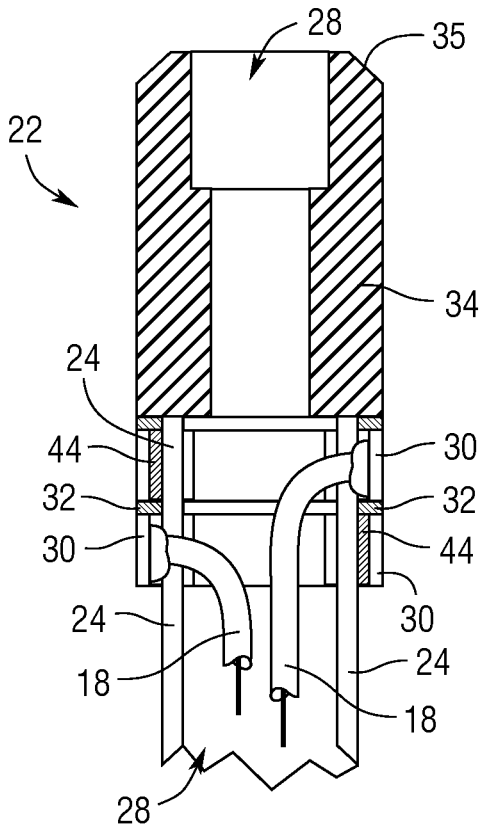
FIG. 10 is a close up cross-sectional side view of the tip of the male connector half, without a coaxial cable positioned in the central burrow of the male connector half.

In the embodiment shown in FIGS. 4 through 9, the male connector half 22 comprises nine male coupling parts 30 and nine male insulator elements 32. As best shown by comparing FIGS. 9 and 10, each male coupling part 30 is substantially ring shaped except an elongated divot 41 and a minor recessed area both located on its interior surface 42. The elongated divot 41 is located opposite to the recessed area where the electrical conduit 18 is joined to the male coupling part 30. The electrical conduit 18 is soldered to the male coupling part 30 and this recessed area is shaped to allow that soldering to join to the male coupling part 30 without unduly spreading along the entire interior surface 42. It should be understood that any method of joining the electrical conduit 18 to the male coupling part 30 that allows for an electrical connection between the electrical conduit 18 and male coupling part 30 may work. It may also be desirable to identify each electrical conduit 18 by uniquely coloring the coating on each electrical conduit 18. The exterior surface 43 of the male coupling part 30 has a high polish finish to smooth this surface and facilitate the limitless rotational electrical connection. It should be understood, that smoothing the exterior surface 43 may be done in other ways, such as, but not limited to, adding an oil based lube to the outer surface 43.

Each male insulator element 32 fastens to its corresponding male coupling part 30 and insulates its corresponding male coupling part 30 by keeping the electricity flowing through the male coupling part from flowing into other male coupling parts 30 mounted on the male connector core 24. Typically the male insulator elements 32 are made from nonconductive injection molded polymer plastic material, but any nonconductive material may work. The male insulator elements 32 are also used to laterally space each male coupling part 30 apart from the next nearest male coupling part 30, ensuring each male coupling part 30 is correctly positioned along the male connector core 24. Each male insulator element 32 comprises a peg 44 that is shaped to compliment the elongated divot 41 of the corresponding male coupling part 30. To fasten the male insulator element 32 to the male coupling part 30, the peg 44 slides into and interlocks with the elongated divot 41.

In certain applications, it may be beneficial for at least one male coupling part 30 laterally mounted along the male connector core 24 to be made from nonconductive material, otherwise known as a "blank male coupling part." This configuration allows for there to be less than nine conductive male coupling parts 30 to be mounted along the male connector core 24 without having to change the length or shape of the male connector core 24. If needed, this configuration also allows for there to be fewer conductive male coupling parts 30 than corresponding conductive female coupling parts, discussed below. Such nonconductive male coupling parts 30 may be made out of the same injection molded polymer plastic material that the male insulator element 32 and/or the male connector core 24 are made out of, but any nonconductive material may work.

As briefly discussed above, the male connector core 24 comprises a central burrow 28 that runs laterally through the center of the male connector core 24 and creates openings on both of its ends. A coaxial cable 46 is insertable into the central burrow 28 such that a male or plug-type connector 49 of the coaxial cable 46 protrudes from the tip 34. The central burrow has a large enough diameter to not only allow the coaxial cable 46 and each electrical conduit 18 to be strewn through it, but also to allow dielectric adhesive (as shown and discussed with respect to FIG. 19, below) to be injected into it. This dielectric adhesive (discussed below) fills in any unused space within the central burrow and, after solidifying, provides surrounding structure around the coaxial cable 46 and each electrical conduit 18 so that each element is completely stationary when the rotatable electric coupling is fully manufactured. The dielectric adhesive also provides electrical insulation within the male connector core 24, further ensuring the electric transmissions traveling through the coaxial cable 46 will not interfere with the electric transmissions travelling through the nearby electrical conduits 18 and the electric transmissions traveling through the electrical conduits 18 will not interfere with the electric transmissions in any other nearby electrical conduit 18.

The coaxial cable 46 is used for transmitting an electric control signal (i.e. a form of electric transmissions) being supplied to the technical equipment, which are, for example, connecting radio transmitters and receivers, computer network (Internet) connections, and cable television signals, etc. In this embodiment, the coaxial cable 46 is a standard SMB connector capable of electric transmissions up to 10 Ghz. It should be understood, any coaxial cable 46 able to properly transmit an electric control signal allowing the technical equipment 16 to function may work. It should also be understood that other types of cable connectors could be used to instead of the coaxial cable 46, such as pneumatic or optical connectors.

When the male coupling parts 30 and corresponding male insulator elements 32 are properly mounted on the male connector core 24, the electric transmissions through each male coupling part 30 does not necessarily have to be the same as the electric transmissions through any other male coupling part 30 on the on the male connector core 23. Each male coupling part 30 is intended to transmit high definition component (RGB) video signals, audio signals, control signals, and/or DC or AC power, but there may be other types of electric transmissions not discussed herein. Since the number and combination of the male coupling parts 30 and corresponding male insulator elements 32 can be mounted on the male connector core 24 in different ways, the combination of electric transmissions through the male coupling parts 30 is flexible and can be modified depending on the specific needed use of the pendant arm system 14.

Figure 11:
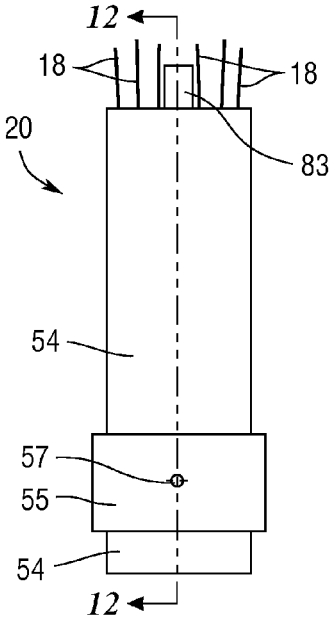
FIG. 11 is a side view of the female connector half.
Figure 12:
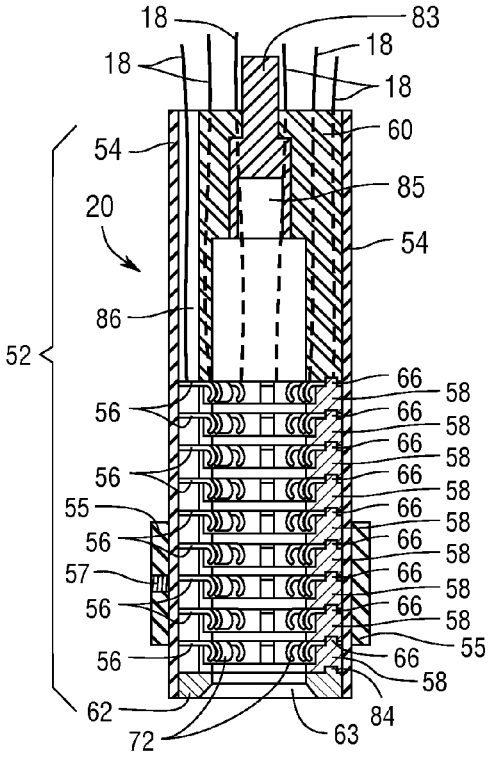
FIG. 12 is a cross-sectional side view of the female connector half of FIG. 11, as depicted by the figure line 12-12.
Figure 13:
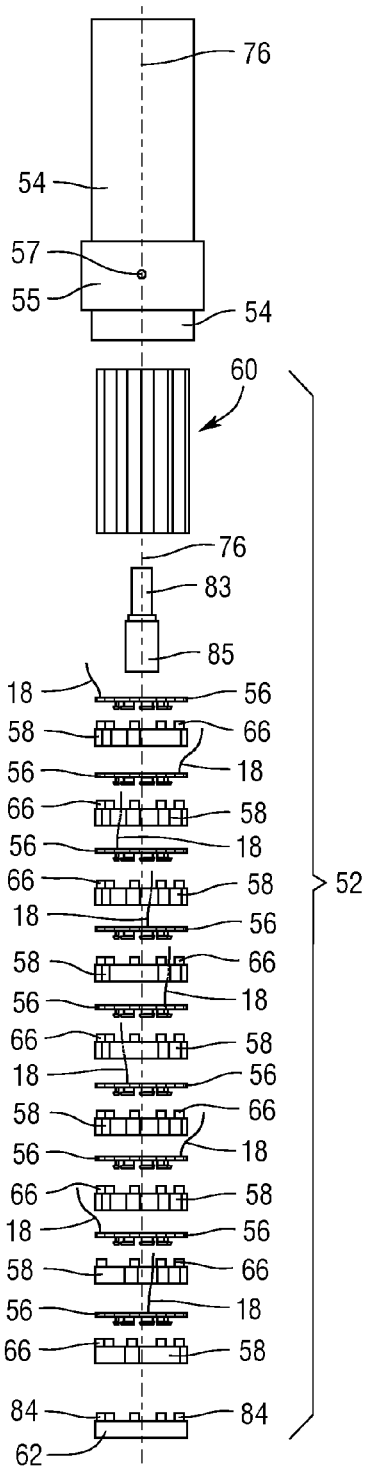
FIG. 13 is an exploded view of the female connector half of FIG. 11.

As shown in FIGS. 11 through 13, the female connector half 20 comprises a female connector core 52 and a female connector housing 54. The female connector housing 54 is generally made from nonconductive injection molded polymer plastic material, but could be made from any material suitable for housing the female connector core 52 (e.g. metallic material).

The female connector housing 54 comprises an outer housing 55 that has a fastening hole 57. Referring back to FIGS. 1-1B, the outer housing 55 helps to properly position the rotatable electric coupling 10 within the pivot joint 12. The fastening hole 57 used in conjunction with a fastener (not shown) that affixes the female connector half 20 in the respective half of the pivot joint 12. Based on the specific dimensions of the pivot joint 12, the position of the outer housing 55 may be customized to any location along the female connector housing 54.

As shown in FIG. 13, the female connector core 52 comprises a plurality of electrically conductive female coupling parts 56, a plurality of nonconductive female core spacers 58, a nonconductive female core base 60, and a nonconductive female end cap 62. This embodiment of the female connector half 20 comprises nine female coupling parts 56 and nine female core spacers 58. Each female coupling part 56 fastens to a corresponding female core spacer 58, creating nine pairs of female coupling parts 56 and female core spacers 58 fastened together. As discussed above, each female coupling part 56 operatively contacts a corresponding male coupling part to maintain the limitless rotational electrical connection. The female core spacers 58, female core base 60, and female end cap 62 are each generally made from nonconductive injection molded polymer plastic material, but any nonconductive material may work for these components.

Figure 14:
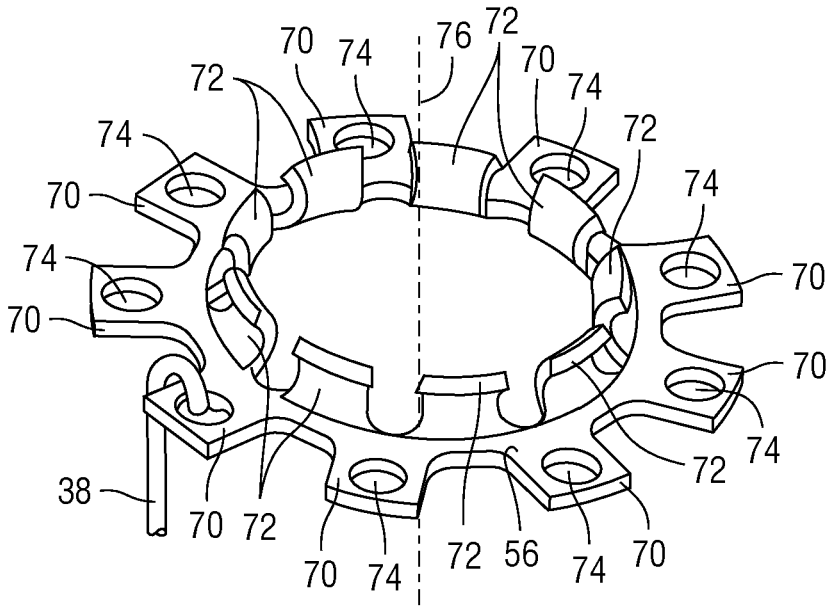
FIG. 14 is a perspective view of a female coupling part.

Referring to FIG. 14, Each female coupling part 56 is made from conductive metallic material so that electric transmissions may pass through when needed. In this embodiment, each female coupling part 56 also has a silver plated smooth finish to facilitate the limitless rotational electrical connection. Each female coupling part 56 comprises a plurality of outward radial tabs 70 and a plurality of inward radial tabs 72. The outward radial tabs 70 extend outwardly from the central axis 76 of the female coupling part 56. Each female coupling part 56 comprises nine independent outward radial tabs 70. Each outward radial tab 70 comprises an opening 74 which has a circular cross-section. It should be understood that the female coupling parts 56 could be made from material that is not metallic, so long as the material is electrically conductive. The plurality of inward radial tabs 72 extend inwardly towards the central axis 76 of the female coupling part 56 and are bent peripherally from the female coupling part 56 in a rounded manner. Each female coupling part 56 comprises nine independent inward radial tabs 74. The inward radial tabs 74 work in conjunction to form an circular-shaped perimeter with a circumference just larger than the circumference of the exterior surface of its corresponding male coupling part.

Figure 15:
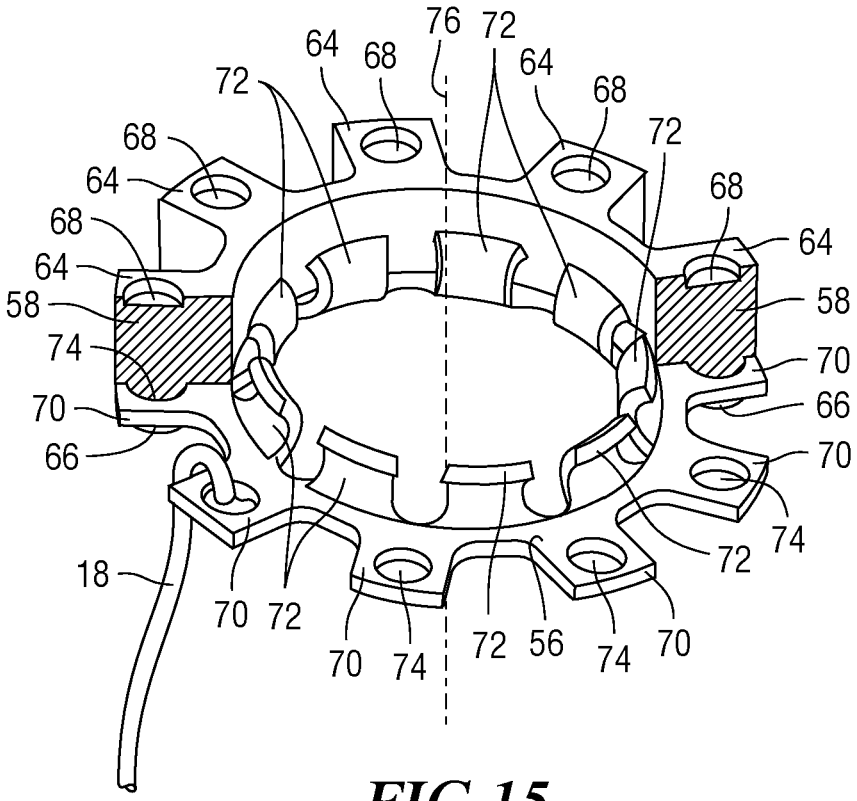
FIG. 15 is a perspective view of the female coupling of FIG. 14 fastened to a female core spacer, with only a portion of the female core spacer shown.

As best seen by comparing FIGS. 13 and 15, each female core spacer 58 comprises a plurality of radial sections 64, which extend outwardly from the central axis 76 of the female core spacer 58. Each female core spacer 58 comprises eight independent radial sections 64. Each radial section 64 itself comprises a projection 66, having a circular cross-section, which extends peripherally from the radial section 64 and parallel to the central axis 76. The projections 66 are sized to fit through the openings 74 of the outward radial tabs 70 in the female coupling part 56. On the side of the radial section 64 opposite the one comprising the projection 66, the radial section comprises a depression 68, having a circular cross-section, which goes into the radial section 64. The radial sections 64, in conjunction with each other, are used to fasten the female core spacer 58 to the female coupling part 56, as discussed in detail below.

Figure 16:
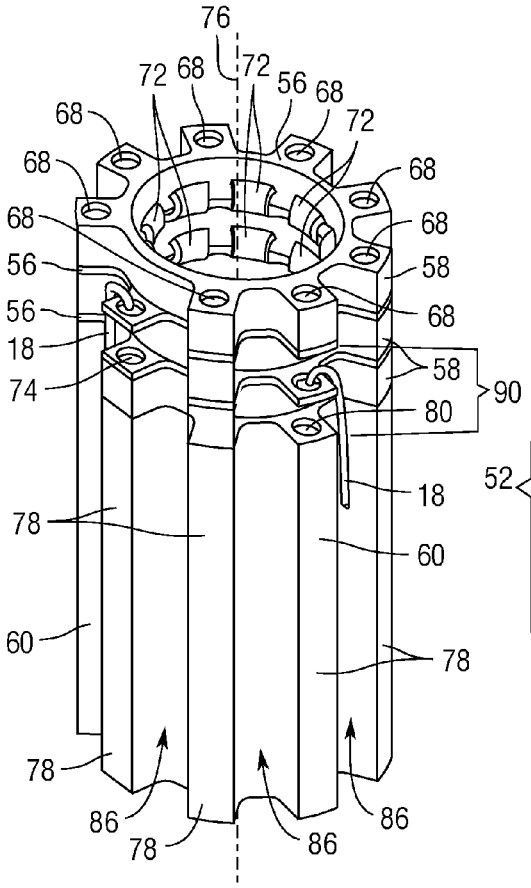
FIG. 16 is a perspective view of a plurality of fastened female coupling parts and female core spacers stacked on a female core base.
Figure 17:
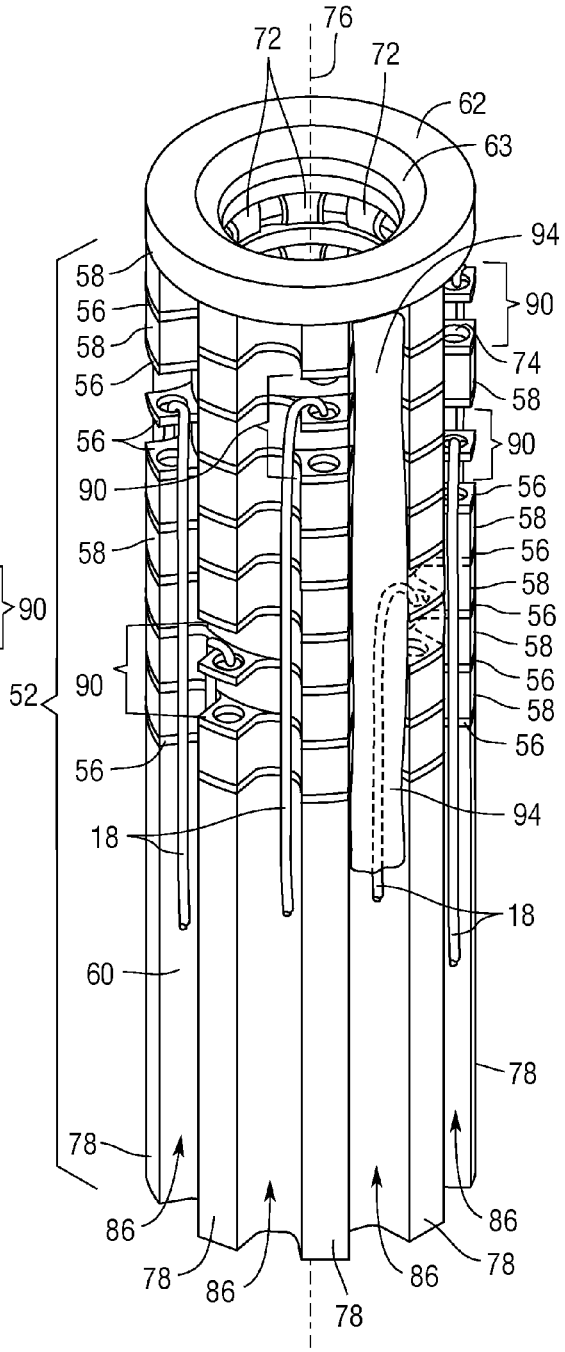
FIG. 17 is a perspective view of a female connector core fastened to a female end cap.

Referring to FIG. 15, to create a fastened pair of female coupling parts 56 and female core spacers 58, the projection 66 on the female core spacer 58 is inserted into and extends beyond the opening 74 on the female coupling part 56. As best seen in FIGS. 16 and 17, each pair of female coupling parts 56 and female core spacers 58 fastened together can be stacked onto another pair of these parts. The projection 66 is long enough that after being inserted into the opening 74, the projection 66 can be inserted into the depression 68 on a corresponding female core spacer 58. The opening 74 on each outward radial tab 70 of each female coupling part 56 compliments the projection 66 on each radial section 64 of the other female core spacers 58. The depression 68 on each radial section 64 of each corresponding female core spacer 58 compliments the projection 66 on each radial section 64 of the other female core spacer 58. A snug fit is maintained between each of the projection 66, opening 74, and depression 68 when the female coupling part 56, female core spacer 58, and any other corresponding female core spacer 58 are stacked together.

The stack of female coupling parts 56 and female core spacers 58 is mounted on the female core base 60. The female core base 60 stabilizes the entire female connector core 52 when the female connector core 52 is in the female connector half 20. The female core base 60 comprises a plurality of radial segments 78, which extend outwardly from the central axis 76 of the female core base 60. The radial segments 78 are identical in nature to the radial sections 64 of the female core spacer 58. Each radial segment 78 comprises a plurality of concavings 80, having a circular cross-section. The concavings 80 are identical in nature to the depressions 68 of the radial sections 64, discussed above.

To properly stack the pairs of female coupling parts 56 and female core spacers 58 fastened together, a first pair of a female coupling part 56 and a female core spacer 58 is mounted on the female core base 60. To mount the first pair of female coupling parts 56 and female core spacers 58 fastened together on to the female core base 60, the exposed portion of the projections 66, which have been inserted into and extended through the openings 74, are inserted into the concavings 80 on the female core base 60. Then a second pair of a female coupling part 56 and a female core spacer 58 is stacked onto the first pair, and each subsequent pair is stacked respectively from there on. When the required number of pairs of female coupling parts 56 and female core spacers 58 fastened together are mounted and stacked onto the female core base 60, the ring-shaped female end cap 62 is fastened (as described below) to the final pair of female coupling parts 56 and female core spacers 58 fastened to complete the female connector core 52.

The ring-shaped female end cap 62 is fastened to the female connector core 52 by fastening to the final pair of female coupling parts 56 and female core spacers 58 fastened together in the stack on the female core base 60. On one side, the female end cap 62 has a plurality of protrusions (not shown). Each protrusion is identical in nature to each of the projections 66 of each female core spacer 58 and each protrusion extends peripherally from the female end cap 62. The protrusions on the female end cap 62 insert into the depressions 68 of the final female core spacer 58 at one end of the female connector core 52. The female end cap 62 fastens to the female connector core 52, in the same manner each female core spacer 58 fastens to a corresponding female core spacer 58, discussed above. On the side that does not fasten to the female connector core 52, the female end cap 62 comprises a cap chamfer 63, which corresponds to the tip chamfer on the male connector core. The cap chamfer 63 assists in directing the male connector half 22 centrally into the female connector half, as discussed below Referring back to FIGS. 11-13, a coaxial contact member 83 is fixedly secured to the female connector core 52 through the center and at the end opposite the one fastened to the female end cap 62. In this embodiment, the coaxial contact member 83 is fixedly secured using dielectric adhesive. The coaxial contact member 83 has a central-docking port 85, which is centrally located in the female connector half 20 when the coaxial contact member 83 is fixedly secured to the female connector core 52. As shown in FIGS. 2-4, the central-docking port 85 allows the plug-type connector 49 of the coaxial cable 46 on the male connector half 52 to slidably mount into it. The coaxial contact member 83 functions as an extension of the coaxial cable 46 that protrudes through the male connector half 22. When the plug-type connector 49 is slidably mounted into the central-docking port 85, any electric transmissions first traveling through the coaxial cable 46 are extended through the coaxial contact member 83. If the rotatable electric coupling 10 is oriented in the opposite manner within the pendant arm system 14, any electric transmissions first traveling through the coaxial contact member 83 are extended through coaxial cable 46.

Referring back to FIG. 17, the female core base 60 comprises a plurality of channels 86. Each channel 86 extends laterally lengthwise along the female core base 60 between two radial segments 78. In this embodiment, the female core base 60 comprises nine channels 86 with each channel 86 being straight from end to end. It will be understood, the female core base 60 could comprise fewer than nine channels 86 and each channel 86 may not be straight, nor do the channels 86 have to each have the same overall shape from end to end. It will be understood that every time a pair of female coupling parts 56 and female core spacers 58 fastened together is fastened to the female core base 60, the space between the outward radial tabs 70 of each female coupling part 56 and the radial sections 64 in the female core spacers 58 act as channel extenders that extend the channels 86 further along the female connector core 52. When the female connector core 52 is complete, except for a missing portion of the walls on each side of the channel 86, discussed below, each channel 86 extends laterally the length of the entire female connector core 52.

As mentioned above, in this embodiment, each female coupling part 56 comprises nine outward radial tabs 70 and each female core spacer 58 comprises eight radial sections 64. As best shown in FIGS. 16 and 17, the female core spacers 58 are constructed such that when one female core spacer 58 and one female coupling part 56 are paired together, one of the radial tabs 70 is free standing and not fastened to a radial section 64. The female core spacers 58 are also constructed such that when a pair of female coupling parts 56 and female core spacers 58 fastened together is stacked against another pair, one radial tab 70 extends outwardly in the center of an axial gap 90 created by these missing radial sections 64. When the female connector core 52 is complete, each axial gap 90 forms a missing portion of the walls on each side of the channel 86 with the radial tab 70 free standing and extending from the middle of this axial gap 90. These axial gaps 90 occur at different lateral locations, creating an offset pattern, along the body of the female connector core 52 for each channel 86.

The free standing radial tab 70 of the female coupling part 56 is joined to an electrical conduit 18. Having the axial gaps 90 occurring at different locations allow each electrical conduit 90 to be positioned in its own respective channel 86. Once positioned in the channel 86, the electrical conduit 18 travels centrally along length of the channel 86 and is secured within the channel 86 with dielectric adhesive 94. The dielectric adhesive 94 is spread throughout the entirety of each channel 86, throughout each axial gap 90, and is used to secure the female connector housing 54 in place on the female connector half 20. This dielectric adhesive 94 fills in any unused space within each channel 86 and each axial gap 90. After the dielectric adhesive 94 has solidified, it provides surrounding structure around each electrical conduit 18 in the respective channel 86 so that electrical conduit 18 remains completely stationary. The dielectric adhesive 94 also provides electrical insulation within in the respective channel 86 and axial gap 90, further ensuring all electric transmissions through the electrical conduit 18 will not interfere with the electric transmissions through the electrical conduits 18 in the nearby adjacent channels 86. The dielectric adhesive 94 also ensures the electrical conduit 18 remains joined to the female coupling part 56. The dielectric adhesive 94 is the same type of dielectric adhesive used to fill the male connector half, as discussed above.

Each female core spacer 58 is thick enough to insulate its corresponding female coupling part 56. Electric transmissions through one female coupling part 56 will not pass through to another female coupling part 56 in the female connector core 52. Typically each female core spacer 58 is made from nonconductive injection molded polymer plastic material, but any nonconductive material may work.

In certain applications, it may be beneficial for the female connector core 52 to comprise at least one female coupling part 56 made from nonconductive material, otherwise known as a "blank female coupling part." This configuration allows for there to be less than nine conductive female coupling parts 56 stacked on the female core base 60 without having to change the length, shape, or channels of the female connector core 52. This configuration also allows for there to be fewer conductive female coupling parts 56 than corresponding conductive male coupling parts, if needed. The nonconductive material constructing this female coupling part 56 may be the same injection molded polymer plastic material that constructs the female core spacers 58 and/or the female core base 60, but any nonconductive material may work.

When the female connector core 52 is complete, the electric transmissions through each female coupling part 56 does not necessarily have to be the same as the electric transmissions through any other female coupling part 56 e on the female connector core 52. However, the electric transmissions running from an individual male coupling part must be the same transmissions through the corresponding female coupling part 56. As discussed with the male coupling parts on the male connector core above, each female coupling part 56 is able to transmit high definition component (RGB) video signals, audio signals, control signals, and/or DC or AC power, but there may be other types of electric transmissions that could travel through the female coupling part 56 not discussed herein. Since the number and combination of the female coupling parts 56 and corresponding female core spacers 58 may vary, the combination of electric transmissions through the female coupling parts 56 is flexible and can be changed depending on the specific use of the pendant arm system 14. As mentioned above, it may also be desirable to identify each electrical conduit 18 by uniquely coloring the coating on each electrical conduit 18.

Referring back to FIGS. 2 through 4, and 12, when the male connector half 22 is operatively inserted into the female connector half 20, the tip chamfer 35, cap chamfer 63, and the circular-shaped perimeter created by the inward radial tabs 72 of the female coupling part 56 all direct the male connector core 24 towards the center of the female connector half 20. This ensures the male connector half 22 is properly inserted into the female connector half 20. Proper insertion of the male connector half 22 also ensures that each female coupling part 56 is operatively contacted to their corresponding male coupling part 30, creating the limitless rotational electrical connection between both the male coupling part 30 and female coupling part 56. This limitless rotational electrical connection is efficient, sturdy, reliable, and durable.

Figure 18:
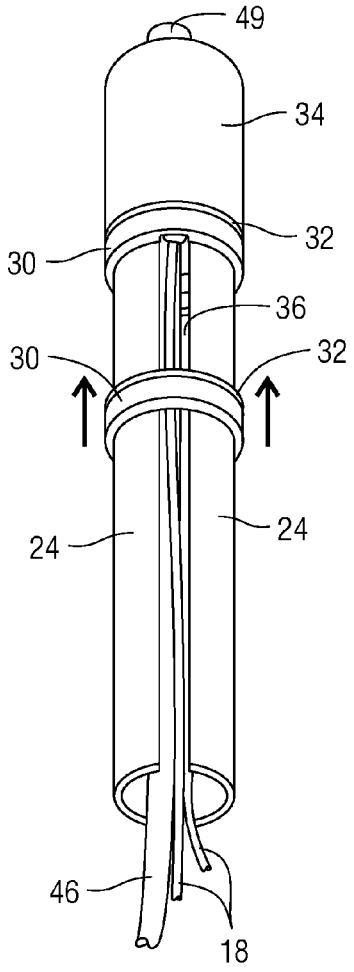
FIG. 18 is a perspective view of a male coupling part and a male insulator element being slidably mounted on a male shaft of the male connector half.
Figure 19:
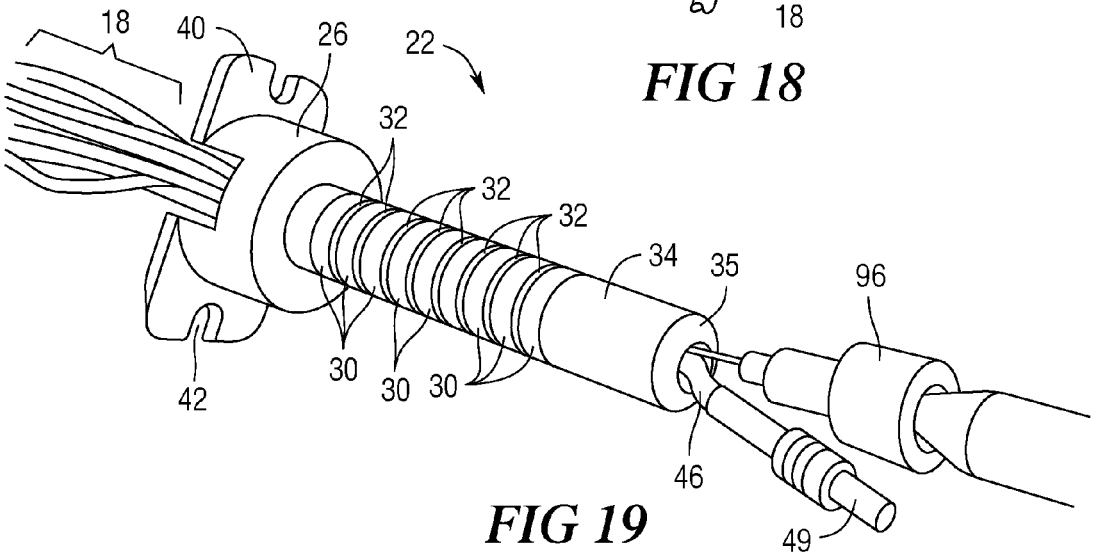
FIG. 19 is a perspective view of an adhesive syringe filling the central burrow of the male connector half with dielectric adhesive.
Figure 20:
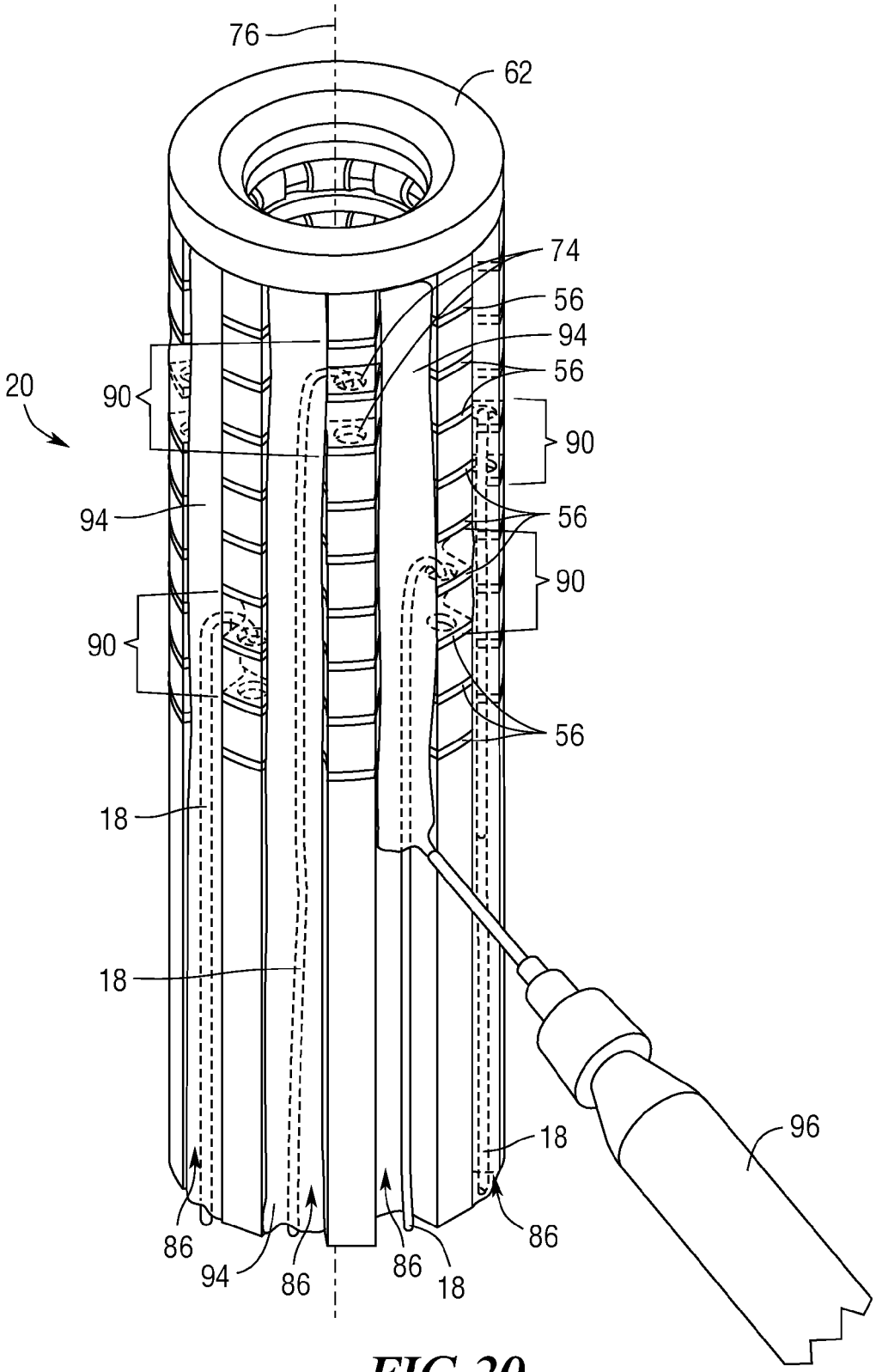
FIG. 20 is a perspective view of an adhesive syringe filling the channels of the female connector half with dielectric adhesive.

As shown in FIGS. 18 through 20, the method of manufacturing the rotatable electric coupling is unique in itself. The male connector half or the female connector half are assembled separately, and it does not matter which connector half is assembled before the other. Each male coupling part 30 and each female coupling part 56 is joined to its own respective electrical conduit 18 prior to the assembly of either the male connector half 22 and female connector half 20. It should be understood, the electrical conduits 18 could be joined to their respective male coupling part 30 and female coupling part 56 at various other times during the manufacture of the rotatable electric coupling.

The manufacture of the male connector half is illustrated in FIGS. 18 and 19. In this embodiment, the male connector half 20 is assembled as follows: 1) one male coupling part 30 is mounted on the male connector core 24; and 2) one male insulator element 32 is mounted on the male connector core 24. These steps should be repeated until all required male coupling parts 30 and all male insulator elements 32 are mounted on the male connector core 23. The male insulator element 32 and male coupling part 30 could also be fastened together before being mounted to the male connector core 23 and then fastened pair both mounted on the male connector core 23 together. In the embodiment shown, nine male coupling parts 30 are mounted on the male connector core 23.

Once all male coupling parts 30 and all male insulator elements 32 are mounted on the male connector core 23, the coaxial cable 46 is inserted into the central burrow 28 in the male connector core 23 such that a male or plug-type connector 49 of the coaxial cable 46 protrudes from the tip 34. The central burrow 28 is then filled with dielectric adhesive using an adhesive syringe 96. When the central burrow 28 is filled and the dielectric adhesive has solidified, manufacture of the male connector half 22 is complete.

Manufacture of the female connector half 20 is shown in FIG. 20. In this embodiment, the female connector half 20 is assembled as follows: 1) one female coupling part 56 is fastened to one female core spacer 58 in such a way that the space between the outward radial tabs 70 of each female coupling part 56 and the radial sections 64 in the female core spacers 58 align to act as channel extenders; and 2) the fastened female coupling part 56 and female core spacer 58 are stacked on the female core base 60 in such a way that the channel 86 of the female core base 60 is extended by the channel extenders of the fastened female coupling parts 56 and female core spacers 58. Fastening one female coupling part 56 to one female core spacer 58 is discussed in more detail above. If the fastened female coupling part 56 and female core spacer 58 pair are already stacked on female core base 60, then step two actually comprises—the fastened female coupling part 56 and female core spacer 58 are stacked the previously and already stacked female coupling part 56 and female core spacer 58 pair, in such a way that the channel 86 of the female core base 60 is extended by the channel extenders of the fastened female coupling parts 56 and female core spacers 58. These steps should be repeated until all fastened female coupling parts 56 and all female core spacers 58 are stacked on the female core base 60, or on an already stacked female coupling part 56 and female core spacer 58.

After the required number of stacked female connector core 52 is created, a female end cap 62 is fastened to create a complete female connector core 52. Then dielectric adhesive 94 is applied into and throughout each of the channels 86 laterally extending along the female connector core 52, within each axial gap 90, and up to the female end cap 62. The dielectric adhesive 94 is used to fixedly secure the coaxial contact member 83 to the female end cap 62. Once the dielectric adhesive 94 has solidified, the coaxial contact member 83 is properly fixedly secured to the female end cap 62 and remains completely stationary.

The completed female connector core 52 is slidably inserted into the female connector housing 54. Although not necessary, it is preferable to slidably insert the female connector core 52 and female end cap 62 into the female connector housing 54 before the dielectric adhesive 94 has solidified, so that the dielectric adhesive 94 fully adheres to the female connector housing. Finally, the position of the outer housing 55 is determined along the female connector housing 54 and the outer housing is 55 is affixed to the female connector housing 55. It should be understood, in the embodiment shown in FIG. 20, for the female connector core 52 to properly fit within the female connector housing, the female connector core 52 can at most mount nine female coupling parts 56 and nine female core spacers 58.

To complete this embodiment of the method of manufacture, the male connector half 22 is inserted directly into the female connector half 20, which completes the rotatable electric coupling 10. Inserting the male connector half 22 into the female connector half 20 is explained in more detail above. It should be understood, when the method of manufacture of the rotatable electric coupling 10 is complete, the number of female coupling parts 56 used may be equal to the number of male coupling parts 30, the number of female coupling parts 56 used may be more than the number of male coupling parts 30, or the number of female coupling parts 56 used may be less than the number of male coupling parts 30. It should also be understood that this method of manufacture is applied to the embodiment of the rotatable electric coupling disclosed and discussed above, but it may also be applied to different embodiments of the rotatable electric coupling.

This invention has been described with reference to several preferred embodiments. Many modifications and alterations will occur to others upon reading and understanding the preceding specification. It is intended that the invention be construed as including all such alterations and modifications in so far as they come within the scope of the appended claims or the equivalents of these claims.

The invention claimed is:

1. A method of manufacturing a rotatable electric coupling, wherein the rotatable electric coupling comprises a male connector half and a female connector half, the male connector half comprises one or more male coupling parts, one or more male insulator elements, and a male connector core having a central burrow, the female connector half comprises a female core base having a channel, one or more female coupling parts having a channel extender, one or more female core spacers having a channel extender, and a female end cap, the method comprises:

assembling the male connector half, which comprises the steps of:

(1) mounting one male coupling part on the male connector core;

(2) mounting one male insulator element on the male connector core;

repeating steps (1) or (2) or both (1) and (2) until all male coupling parts and all male insulator elements are mounted on the male connector core; and filling the central burrow in the male connector core with dielectric adhesive;

assembling the female connector half, which comprises the steps of:

(1) fastening one female coupling part to one female core spacer in such a way that the channel extenders are aligned;

(2) stacking the fastened female coupling part and female core spacer on the female core base or on an already stacked female coupling part and female core spacer, in such a way that the channel of the female core base is extended by the channel extenders of the fastened female coupling parts and female core spacers;

repeating steps (1) or (2) or both (1) and (2) until all fastened female coupling parts and female core spacers are stacked on the female core base or on an already stacked female coupling part and female core spacer, creating a female connector core;

fastening the female end cap to the female connector core;

applying dielectric adhesive throughout the channel of the female connector core; and inserting the female connector core and female end cap into a female connector housing; and inserting the male connector half into the female connector half to complete the rotatable electric coupling.

2. The method of manufacturing the rotatable electric coupling of claim 1 wherein:

each male coupling part comprises an elongated divot and each male insulator element comprises a peg; and assembling the male connector half further comprises the step of interlocking the peg of the male insulator element with the elongated divot of the male coupling part.

3. The method of manufacturing the rotatable electric coupling of claim 1 further comprises joining each male coupling part to an electrical conduit.

4. The method of manufacturing the rotatable electric coupling of claim 1 further comprises joining each female coupling part to an electrical conduit.

5. The method of manufacturing the rotatable electric coupling of claim 1 wherein assembling the male connector half further comprises inserting a coaxial cable into the central burrow.

6. The method of manufacturing the rotatable electric coupling of claim 1 wherein assembling the female connector half further comprises fixedly securing a coaxial contact member to the female end cap.

7. The method of manufacturing the rotatable electric coupling of claim 1 wherein the male connector core can at most mount nine male coupling parts.

8. The method of manufacturing the rotatable electric coupling of claim 1 wherein the number of female coupling parts used in the manufacture of the rotatable electric coupling is equal to the number of male coupling parts.

9. The method of manufacturing the rotatable electric coupling of claim 1 wherein the number of female coupling parts used in the manufacture of the rotatable electric coupling is not equal to the number of male coupling parts.

10. The method of manufacturing the rotatable electric coupling of claim 1 wherein the male connector core comprises a lateral flange for securing the rotatable electric coupling to a pendant arm system.

11. The method of manufacturing the rotatable electric coupling of claim 1 wherein the channel extender of each female core spacer is formed from a plurality of radial sections, the plurality of radial sections for fastening to the female coupling part.

12. The method of manufacturing the rotatable electric coupling of claim 1 wherein the channel of the female core base is formed from a plurality of radial segments, the plurality of radial sections for stacking the fastened one female coupling part and one female core spacer on the female core base.

13. The method of manufacturing the rotatable electric coupling of claim 1 wherein each female coupling part comprises a plurality of outward radial tabs.

14. The method of manufacturing the rotatable electric coupling of claim 1 wherein each female coupling part comprises a plurality of outward radial tabs and at least one of the plurality of outward radial tabs assists in fastening the female coupling part to the female core spacer.

15. The method of manufacturing the rotatable electric coupling of claim 1 wherein each female coupling part comprises a plurality of inward radial tabs bent peripherally for operatively contacting a corresponding male coupling part.

16. The method of manufacturing the rotatable electric coupling of claim 1 wherein at least one of the male coupling parts is made from nonconductive material.

17. The method of manufacturing the rotatable electric coupling of claim 1 wherein at least one of the female coupling parts is made from nonconductive material.

18. The method of manufacturing the rotatable electric coupling of claim 1 wherein:

the female core base having a plurality of channels;

each female coupling part having a plurality of channel extenders; and each female core spacer having a plurality of channel extenders.

19. A rotatable electric coupling for maintaining a continuous electric connection through a pivot joint of a pendant arm system or other similar apparatus that comprises the pivot joint, said rotatable electric coupling comprises:

a female connector half for corresponding with a male connector half to maintain the continuous electric connection, said female connector half comprises a female connector core and a female connector housing;

said female connector core comprises:

a female coupling part for operatively contacting a corresponding male coupling part, said female coupling part and said male coupling part maintain a rotational connection;

a female core spacer fastened to said female coupling part, said female core spacer for insulating said female coupling part;

said female core spacer and said female coupling part mounted to a female core base, said female core base for stabilizing said female connector core in said female connector half, said female core base having a channel; and said channel is extended when said female core spacer and said female coupling part are mounted on said female core base, said channel laterally extending along said female connector core; and said male connector half comprises:

said male coupling part for operatively contacting said corresponding female coupling part, said male coupling part and the female coupling part maintain the rotational connection;

a male insulator element fastened to said male coupling part, said male insulator element for insulating said male coupling part;

both said male coupling part and said male insulator element mounted on a male connector core, said male connector core having a central burrow; and said male connector core for stabalizing both said male coupling part and said male insulator element when said male connector half is operatively inserted into said female connector half.

20. The rotatable electric coupling of claim 19 further comprises an electrical conduit joined to said female coupling part.

21. The rotatable electric coupling of claim 19 further comprises an electrical conduit joined to said female coupling part and secured within said channel with dielectric adhesive.

22. The rotatable electric coupling of claim 19 further comprises an electrical conduit joined to said male coupling part.

23. The rotatable electric coupling of claim 19 further comprises a female end cap fastened to said female connector core.

24. The rotatable electric coupling of claim 19 wherein said female coupling part for operatively contacting the corresponding male coupling part to create a limitless rotational connection between both said male coupling part and said female coupling part.

25. The rotatable electric coupling of claim 19 wherein said central burrow of said male connector core is filled with dielectric adhesive.

26. The rotatable electric coupling of claim 19 wherein said female core spacer comprises a plurality of radial sections for fastening to said female coupling part.

27. The rotatable electric coupling of claim 19 wherein said female core base comprises a plurality of radial segments for fastening to said female core spacer.

28. The rotatable electric coupling of claim 19 wherein said female coupling part comprises a plurality of inward radial tabs bent peripherally for operatively contacting the corresponding said male coupling part.

29. The rotatable electric coupling of claim 19 wherein said female coupling part comprises a plurality of outward radial tabs and at least one of said plurality of outward radial tabs is for fastening to said female core spacer.

30. The rotatable electric coupling of claim 19 further comprises a coaxial cable inserted into said central burrow for transmitting an electric control signal.

31. The rotatable electric coupling of claim 19 further comprises:

said male coupling part comprises an elongated divot;

said male insulator element comprises a peg; and said peg of said male insulator element is interlocked with said elongated divot of said male coupling part.

32. The rotatable electric coupling of claim 19 wherein said male connector core comprises a lateral flange for securing the rotatable electric coupling to the pivot joint of the pendant arm system.

33. The rotatable electric coupling of claim 19 wherein:

said male connector half comprises a plurality of male coupling parts; and at least one of said male coupling parts is made from nonconductive material.

34. The rotatable electric coupling of claim 19 wherein:

said female connector half comprises a plurality of female coupling parts; and at least one of said female coupling parts is made from nonconductive material.

35. The rotatable electric coupling of claim 19 wherein:

said female core base having a plurality of channels; and each channel is extended when said female core spacer and said female coupling part are mounted on said female core base.

* * * * *